US006561445B2

(12) United States Patent
Yamamoto et al.

(10) Patent No.: US 6,561,445 B2
(45) Date of Patent: May 13, 2003

(54) HULLING APPARATUS

(75) Inventors: Soichi Yamamoto, Tendo (JP); Waichiro Matsuda, Yamagata-ken (JP); Futoshi Ohta, Higashine (JP); Toshiaki Kobayashi, Sagae (JP)

(73) Assignee: Kabushiki Kaisha Yamamoto-Seisakusho, Tendo (JP)

( * ) Notice: Subject to any disclaimer, the term of this patent is extended or adjusted under 35 U.S.C. 154(b) by 159 days.

(21) Appl. No.: 09/782,727

(22) Filed: Feb. 13, 2001

(65) Prior Publication Data

US 2001/0013559 A1 Aug. 16, 2001

(30) Foreign Application Priority Data

Feb. 14, 2000 (JP) ..... 2000-034742
Feb. 14, 2000 (JP) ..... 2000-034743
Feb. 14, 2000 (JP) ..... 2000-034744

(51) Int. Cl.[7] ..... B02C 9/02

(52) U.S. Cl. ..... 241/47; 241/65; 241/79.1; 241/DIG. 30

(58) Field of Search ..... 241/7, 8, 9, 79.1, 241/47, 23, 24.26, DIG. 30, 65, 186.5

(56) References Cited

U.S. PATENT DOCUMENTS 3,818,822 A * 6/1974 Rehder ..... 241/7
5,250,313 A * 10/1993 Giguere ..... 241/10
5,620,145 A * 4/1997 Masuda ..... 241/19
5,699,724 A * 12/1997 Wettstein et al. ..... 241/14
5,713,526 A * 2/1998 Martin et al. ..... 241/7

* cited by examiner

*Primary Examiner*—John M. Husar
(74) *Attorney, Agent, or Firm*—Knobbe, Martens, Olson & Bear, LLP

(57) ABSTRACT

A hulling apparatus that can improve hulling efficiency and hulling roll durability. A first air nozzle and a second air nozzle to cool surfaces of hulling rolls by blowing compressed air thereto are provided at a vicinity of the hulling rolls of the hulling apparatus. Consequently, a hardness of a rubber layer at the surfaces of the hulling rolls can be prevented from being lowered. Thus, hulling efficiency and hulling roll durability can be improved.

20 Claims, 8 Drawing Sheets

HULLING APPARATUS

BACKGROUND OF THE INVENTION

1. Field of the Invention

The present invention relates to a hulling apparatus that husks paddy rice supplied thereto at a hulling section to be discharged as milling-processed grain, and that sorts specific grains from the milling-processed grain by winnowing the milling-processed grain at a winnowing section.

2. Description of the Invention

A hulling apparatus that husks paddy rice supplied from a paddy rice storage tank and removes brown rice is conventionally known. This type of hulling apparatus is provided with a hulling section that husks paddy rice supplied from a paddy rice storage tank, and a winnowing section for respectively sorting and removing brown rice, partially hulled paddy rice, immature grains and husks, from milling-processed grains that have passed through the hulling section.

A pair of opposing hulling rolls separated by a fine gap is disposed in the hulling section. Rotational speeds for the hulling rolls are set to be somewhat different. Paddy rice passes through the gap between the hulling rolls to be milled and husked (so-called hulling).

A whole grain conveyor for removing paddy rice and brown rice, an immature grain conveyor for removing small grains and empty grains, and a hull conveyor for removing hulls are sequentially aligned at the winnowing section. These conveyors are mutually linked by a winnowing path. By operating a blower, air is circulated along a predetermined circulation passage including the winnowing path. Differences in specific gravities of the respective grains are utilized in the process, and sorting of brown rice and the like is conducted in sequential order.

However, in the case of the conventional hulling apparatus described above, because the hulling section is disposed at an inclined position with respect to a wide winnowing section, milling-processed grain subjected to husking processing at the hulling section fall locally with respect to the winnowing section. For this reason, there has been the problem that disparities arise in the dropping density of milling-processed grains with respect to the air current (sorting wind) circulated along the predetermined circulation passage, so that a sufficient winnowing effect cannot be obtained. Moreover, since there is not much space between the hulling section and the winnowing section, it has been difficult to create a large-scale apparatus to solve this problem.

In addition, in the case of the conventional hulling apparatus described above, sorting of brown rice and paddy rice in the whole grain conveyor, sorting of immature grains (small grains and empty grains) in the immature grain conveyor, and collection of husks in the hull conveyor are all invariably carried out. However, depending on the geographical region, there are also places in which the sorting of immature grains in the immature grain conveyor is unnecessary. In America, for example, sorting of immature grains has always been deemed unnecessary, and it is acceptable to mill immature grains together with whole grains. If the above conventional hulling apparatus is exported to such a region and used as it is, so that brown rice and paddy rice are sorted from milling-processed grain husked at the hulling section, immature grains are sorted thereafter, and then immature grains are placed together again with brown rice and paddy rice and sent to the next process, the procedure becomes exceedingly irrational. Furthermore, there has also been the problem that accessory parts disposed in the immature grain conveyor, such as immature grain screw conveyors and pulleys and bearings relating thereto, become useless when the conventional hulling apparatus is exported to such a region.

Still further, in the case of the conventional hulling apparatus described above, when the hulling rolls are used over a long period of time, a rubber layer at the outer periphery of the hulling rolls becomes heated and the hardness of the rubber is lowered (i.e., the rubber becomes soft). When the hardness of the rubber is lowered, hulling efficiency drops and the lifespan of the hulling rolls is shortened.

SUMMARY OF THE INVENTION

In order to solve the aforementioned problems, a hulling apparatus pertaining to a first aspect of the present invention comprises: (A) a hulling section to husk paddy rice supplied thereto and discharge the paddy rice as milling-processed grains; (B) a winnowing section disposed beneath the hulling section, the winnowing section selecting specific grains from the milling-processed grains by winnowing the milling-processed grains discharged from the hulling section and having a winnowing width wider than a milling-processed grain discharge width of the hulling section; and (C) a uniform disperser disposed between the hulling section and the winnowing section, the uniform disperser structured by a lengthy uniform disperser trough having a longitudinal direction dimension substantially the same as the winnowing width of the winnowing section and a uniform disperser screw axially rotatable within a lower interior of the uniform disperser trough and that, by rotating around an axis, conveys in an axial direction milling-processed grains that are discharged from the hulling section to flow into the uniform disperser trough.

According to the present invention, paddy rice supplied to the hulling section is husked at the hulling section and discharged as milling-processed grain. The winnowing section is disposed below the hulling section. Milling-processed grain discharged from the hulling section is winnowed at the winnowing section. Using differences in specific gravity, specific grains are sorted from the milling-processed grain.

In the hulling apparatus to which the present invention is directed, the winnowing width of the winnowing section is wider in comparison to the width of milling-processed grain discharged from the hulling section. Therefore, milling-processed grain discharged from the hulling section falls locally toward the winnowing section, as has been the case conventionally.

However, in the present invention, because a milling-processed grain uniform dispersing means is provided between the hulling section and the winnowing section, milling-processed grains that have flowed locally into the uniform disperser trough from the hulling section are conveyed by the uniform disperser screw in a width direction (i.e., an axial direction) of the winnowing section. In this conveyance process, milling-processed grains are uniformly dispersed and drop across a substantially entire region of the winnowing section so that the milling-processed grains spill over from a uniform disperser trough. Hence, the dropping density of the milling-processed grain with respect to the sorting wind blown at the winnowing section is equalized.

A hulling apparatus pertaining to a second aspect of the present invention comprises: (A) a hulling section to husk paddy rice supplied thereto and discharge the paddy rice as milling-processed grains; (B) a winnowing section disposed beneath the hulling section, the winnowing section having a whole grain conveyor to select whole grains from the milling-processed grains by winnowing the milling-processed grains discharged from the hulling section and an immature grain conveyor to select immature grains from the milling-processed grains; (C) an opening of a whole grain conveyor trough in the whole grain conveyor and an opening of an immature grain conveyor trough in the immature grain conveyor being connected to one another by a winnowing path having an ascending pitch such that a position of the opening of the immature grain conveyor trough is higher than a position of the opening of the whole grain conveyor trough; and (D) an open/close device to open up and close off the opening provided at the opening of the immature grain conveyor trough.

According to the present invention, paddy rice supplied to the hulling section is husked at the hulling section and discharged as milling-processed grain. The winnowing section is disposed below the hulling section. Milling-processed grain discharged from the hulling section is winnowed at the winnowing section. Using differences in specific gravity, specific grains are sorted from the milling-processed grain. Namely, whole grains (a large amount of brown rice and a small amount of paddy rice) are sorted at the whole grain conveyor. Further, immature grains (small grains and empty grains) are sorted at the immature grain conveyor.

Here, the opening of the whole grain conveyor trough in the whole grain conveyor and the opening of the immature grain conveyor trough in the immature grain conveyor are connected to one another by the winnowing path having an ascending pitch such that the position of the opening of the immature grain conveyor trough is higher than the position of the opening of the whole grain conveyor trough, and the open/close means to open up and close off the opening disposed at the opening of the immature grain conveyor trough is provided. Therefore, it become possible to alter the set-up of the immature grain conveyor in accordance with whether or not it is necessary to sort immature grains in a particular market.

Namely, for a market in which sorting of immature grains is necessary, the opening of the immature grain conveyor trough in the immature grain conveyor is opened up by an open/close means. In this case, when the milling-processed grains subjected to husking processing are winnowed, brown rice and paddy rice that are whole grains and have a relatively heavy specific gravity fall toward the opening of the whole grain conveyor trough in the whole grain conveyor and flow therein. At this time, small grains and empty grains that are immature grains and have a specific gravity lighter than that of the whole grains pass through the opening of the whole grain conveyor trough, but fall by their own weight toward the opening of the immature grain conveyor trough in the immature grain conveyor to flow therein. Accordingly, sorting of the immature grains is accomplished.

On the other hand, for a market in which sorting of the immature grains is unnecessary, the opening of the immature grain conveyor trough in the immature grain conveyor is closed off by the open/close means. In this case, when the milling-processed grains subjected to husking processing are winnowed, brown rice and paddy rice that are whole grains and have a relatively heavy specific gravity fall toward the opening of the whole grain conveyor trough in the whole grain conveyor and flow therein. At this time, small grains and empty grains that are immature grains and have a specific gravity lighter than that of the whole grains pass through the opening of the whole grain conveyor trough, but fall by their own weight toward the opening of the immature grain conveyor trough in the immature grain conveyor. However, because the opening of the immature grain conveyor trough is closed off by the open/close means, the immature grains fall onto the open/close means. Here, in the present invention, because the opening of the whole grain conveyor trough and the opening of the immature grain conveyor trough are mutually connected by the winnowing path having an ascending pitch, the immature grains that have fallen onto the open/close means flow down along the winnowing path and fall toward the opening of the whole grain conveyor trough to merge with the whole grains. Accordingly, sorting of the immature grains may be selected.

A hulling apparatus pertaining to a third aspect of the present invention comprises: (A) a hulling section having a pair of hulling rolls, the hulling section husking paddy rice supplied to a gap between the hulling rolls and discharging the paddy rice as milling-processed grains; (B) a winnowing section disposed beneath the hulling section, the winnowing section selecting specific grains from the milling-processed grains by winnowing the milling-processed grains discharged from the hulling section; and (C) a roll-cooling device to cool the hulling rolls.

According to the present invention, paddy rice supplied to the hulling section is fed to the gap between the pair of hulling rolls provided at the hulling section. The surface of the hulling rolls is formed by a rubber layer, and the hulling rolls rotate at mutually different rotational speeds. Therefore, relative rotation is generated at the position of maximum proximity of the hulling rolls. Using the relative rotation, paddy rice is milled to administer husking processing and the paddy rice is discharged as milling-processed grains. The winnowing section is disposed beneath the hulling section, and milling-processed grains discharged from the hulling section are winnowed at the winnowing section. Accordingly, specific gravity is used to sort specific grains from the milling-processed grains.

Here, when the hulling rolls are used over a long period of time, the rubber layer on the surfaces on the hulling rolls becomes heated, whereby the hardness of the rubber is lowered. However, in the present invention, because air is blasted onto the hulling rolls from the roll-cooling means provided at a vicinity of the positions at which the hulling rolls are disposed, whereby the hulling rolls are cooled, the hardness of the rubber is highly maintained.

DETAILED DESCRIPTION OF THE PREFERRED EMBODIMENTS

First Aspect

A hulling apparatus 10 pertaining to a first aspect of the present invention will be described using FIGS. 1 to 4.

Figure 1:
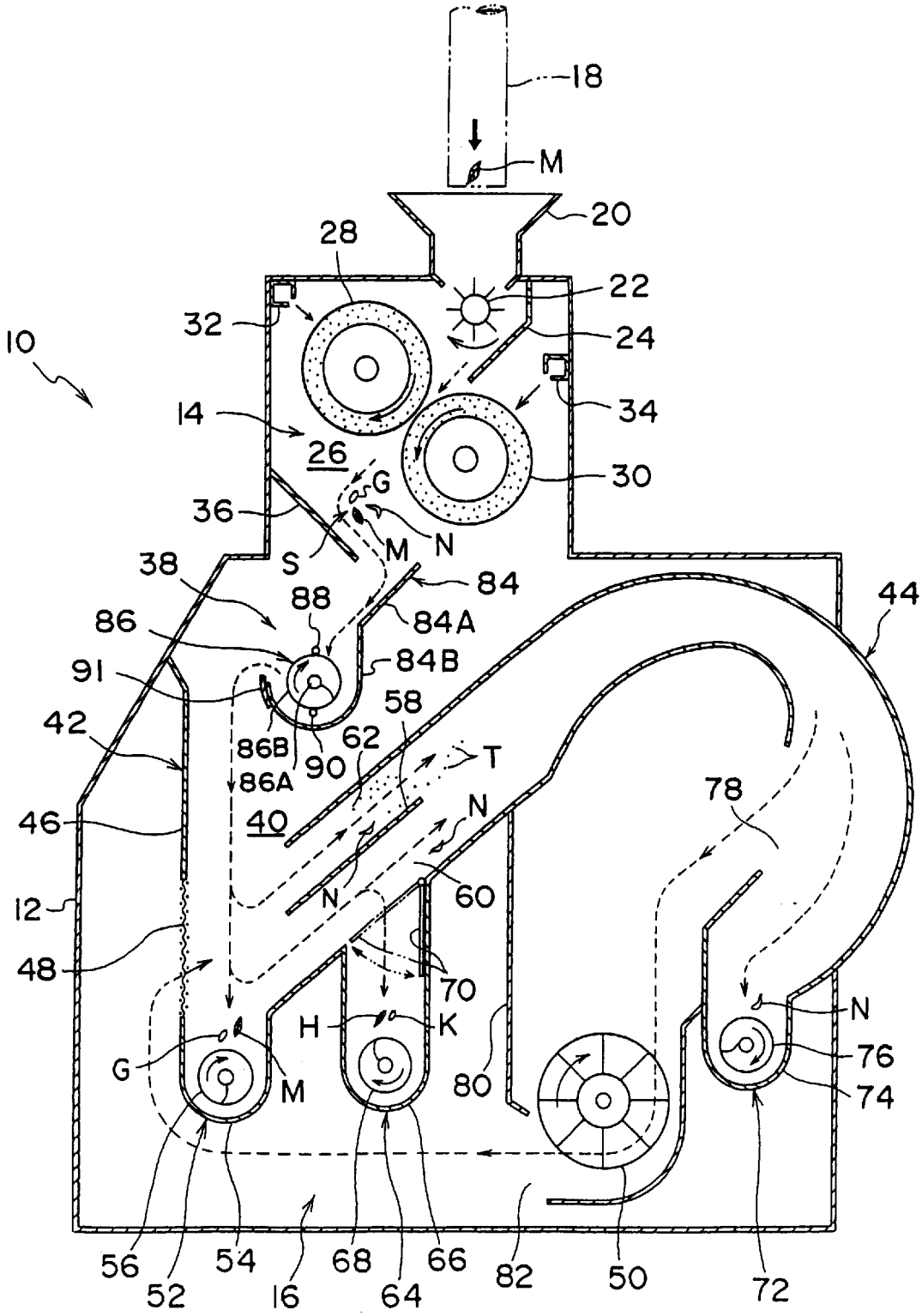
FIG. 1 is a longitudinal cross-sectional view schematically illustrating an overall structure of a hulling apparatus pertaining to a first aspect of the present invention.

In FIG. 1, an outline of an overall structure of the hulling apparatus 10 of the first aspect is illustrated in longitudinal cross section. As shown in the figure, the hulling apparatus 10 is provided with a casing 12 that forms an outer contour of the apparatus. A hulling section 14 is disposed at an upper region of the casing 12, and a winnowing section 16 is disposed at a lower region of the casing 12. The main part of the hulling apparatus is structured by the hulling section 14 and the winnowing section 16.

A paddy rice supply hopper 20 for supplying paddy rice M from a paddy rice supply hose 18 connected to a paddy rice storage tank (not shown in the drawings) is disposed at an upper end region of the casing 12. Paddy rice M is cast into the hulling apparatus 10 through the paddy rice supply hopper 20. An upper part of the paddy rice supply hopper 20 is formed in a conical configuration and a lower part of the same is formed in a funnel configuration. A feed bulb 22 for adjusting amounts fed thereto at the time paddy rice is fed toward a pair of hulling rolls 28 and 30 is disposed directly beneath the paddy rice supply hopper 20. The feed bulb 22 is structured so as to be rotatable in the direction of the solid line arrow in FIG. 1. When the feed bulb 22 is in a state of non-rotation, the paddy rice M cast toward the paddy rice supply hopper 20 is not fed thereto (i.e., an opening at the lower part of the paddy rice supply hopper 20 is closed off). When the feed bulb 22 is in a state of rotation, an amount of paddy rice M corresponding to the rotational speed of the feed bulb 22 is fed toward the pair of hulling rolls 28 and 30. Further, a guide plate 24 inclined at a predetermined angle of inclination is disposed adjacently beneath the feed bulb 22.

A hulling chamber 26 is provided beneath the feed bulb 22. A pair of opposing hulling rolls 28 and 30 having outer peripheries formed of a rubber layer of predetermined hardness is disposed along the directional guide path of the guide plate 24 (i.e., along the direction of inclination) in the hulling chamber 26. The hulling rolls 28 and 30 are disposed such that the position of greatest proximity between the two rolls is positioned along the direction in which the paddy rice M is guided. Accordingly, paddy rice M fed from the feed bulb 22 flows down along the guide plate 24 and is guided as it is toward the pair of hulling rolls 28 and 30. A standard dimension for the gap at the position of greatest proximity between the pair of hulling rolls 28 and 30 is set at 0.8 mm, and is adjustable at units of 0.1 mm. Adjustment is carried out by a motor (not shown in the drawings) for adjusting the gap between the hulling rolls.

The hulling rolls 28 and 30 are rotated around respective axes by a driving force of a main motor (not shown in the drawings) being transmitted thereto. Rotational speeds of the pair of hulling rolls 28 and 30 are set to be somewhat different from one another. For example, supposing that the rotational speed of the hulling roll 28 situated toward the left in FIG. 1 is set to 1200 rpm, the rotational speed of the hulling roll 30 situated toward the right in FIG. 1 might be set to 1000 rpm. By making the rotational speeds of the hulling rolls 28 and 30 somewhat different, the outer peripheries of the hulling rolls 28 and 30 at their point of greatest proximity mutually rotate relative to each other. Moreover, because the thickness of paddy rice M that enters the gap at the position of greatest proximity between the pair of hulling rolls 28 and 30 is larger than the dimension of the gap itself, the paddy rice M is milled, whereby hulling (husking processing) is performed.

A first air nozzle 32 formed in a long configuration along an axial direction of the hulling roll 28 is disposed in the vicinity of the hulling roll 28 that is situated toward the left in FIG. 1 (i.e., at the upper left-hand corner of the casing 12 in FIG. 1). Similarly, a second air nozzle 34 formed in a long configuration along an axial direction of the hulling roll 30 is disposed in the vicinity of the hulling roll 30 that is situated toward the right in FIG. 1 (i.e., near the guide plate 24). The first air nozzle 32 and second air nozzle 34 have a function to lower the surface temperature of the hulling rolls 28 and 30 (i.e., to cool the hulling rolls 28 and 30) by blasting air toward the same.

Paddy rice M that has passed through the pair of hulling rolls 28 and 30 and has thereby been subjected to husking processing will hereinafter be called "milling-processed grains S". These milling-processed grains S are a mixture of a large amount of hulled brown rice G, a small amount of partially hulled paddy rice M, small grains K and empty grains H ("empty grain" refers to a grain having essentially only a hull and nothing therein) that are both immature grains, and hulls N.

A guide plate 36 is provided at a side of the pair of hulling rolls 28 and 30 at which the milling-processing grains are discharged. The guide plate 36 also is disposed at a predetermined angle of inclination. Specifically, the guide plate 36 is disposed at an angle substantially orthogonal to the guide plate 24 provided beneath the feed bulb 22.

A uniform disperser 38 is provided beneath the guide plate 36. The uniform disperser 38 functions as a "milling-processed grain uniform dispersion means" to uniformly disperse milling-processed grains S discharged from the pair of hulling rolls 28 and 30 and drop the milling-processed grains S to the width of the winnowing section 16 (extending from the bottom of FIG. 1 into the depth direction of the same).

The winnowing section 16 to sort specific grains from the milling-processed rice S that has been subjected to husking processing is disposed beneath the hulling section 14. The winnowing section 16 is provided with a winnowing chamber 40. The winnowing chamber 40 is provided with a vertical winnowing path 42 vertically disposed along the path in which the milling-processed rice S falls from the uniform disperser 38 and a main winnowing path 44 having one end connected to the vertical winnowing path 42 at a lower end vicinity of the vertical winnowing path 42 and a schematic shape resembling an overturned J.

A ventilation port 48 structured by a wire netting or a porous plate is formed at a lower end of a vertical wall 46 of the vertical winnowing path 42. Air blasted by a blower 50 disposed in a vicinity of another end of the main winnowing path 44 is blown through the ventilation port 48.

A whole grain conveyor 52 for sorting paddy rice M and brown rice G from the milling-processed grains S is disposed at a lower end of the vertical winnowing path 42. The whole grain conveyor 52 has a whole grain conveyor trough 54 and a whole grain screw conveyor 56. The whole grain conveyor trough 54 is disposed along the longitudinal direction of the hulling apparatus 10 (i.e., from the bottom of FIG. 1 toward the depth direction of the same) and has a substantial U-shape when seen in cross section, and an upper side thereof opens in a vertical direction of the hulling apparatus 10. The whole grain screw conveyor 56 is axially rotatable within a lower interior of the whole grain conveyor trough 54 around an axis by a driving force of a main motor (not shown in the drawings). At the whole grain conveyor 52, milling-processed rice S that has fallen from the uniform disperser 38 is winnowed by a sorting wind passing through the ventilation port 48. Small grains K, empty grains H and hulls N whose specific gravity is relatively light are blown toward the main winnowing path 44. A small amount of partially hulled paddy rice M and a large amount of hulled brown rice G whose specific gravity is relatively heavy fall toward the whole grain conveyor 52. Accordingly, paddy rice M and brown rice G are sorted from the milling-processed rice S.

It should be noted that the paddy rice M and the brown rice G that have fallen into the whole grain conveyor 52 are conveyed to a first port (not shown in the drawings) provided in the depth direction of FIG. 1 and sent to a separate paddy rice and brown rice sorting apparatus (not shown in the drawings).

A partition wall 58 that inclines upwardly toward the right in FIG. 1 is provided at one end in the main winnowing path 44 (i.e., at the side connected to the vertical winnowing path 42, which is also the upstream side with respect to the blasted wind). The partition wall 58 partitions an end portion of the main winnowing path 44 into a lower winnowing path 60, through which small grains K and empty grains H (both being immature grains) are conveyed, and an upper winnowing path 62, through which hulls N and dust T that are lighter than the immature grains are conveyed.

An immature grain conveyor 64 for sorting the small grains K and the empty grains H from the milling-processed grains S that have been sorted from the paddy rice M and the brown rice G is provided beneath the lower winnowing path 60. The immature grain conveyor 64 has an immature grain conveyor trough 66 and an immature grain screw conveyor 68. The immature grain conveyor trough 66 is disposed along the longitudinal direction of the hulling apparatus 10 and has a substantial U-shape when seen in cross section, and an upper side thereof opens in a vertical direction of the hulling apparatus 10. The immature grain screw conveyor 68 is axially rotatable within a lower interior of the immature grain conveyor trough 66 around an axis by a driving force of a main motor (not shown in the drawings). Moreover, an open/close valve 70 for opening up or closing off an opening at an upper end of the immature grain conveyor trough 66 is provided at the same. At the immature grain conveyor 64, only small grains K and empty grains H are dropped and sorted from the small grains K, empty grains H and hulls N that have been sorted from the milling-processed grains S by the partition wall 58 and passed into the lower winnowing path 60.

It should be noted that the small grains K and the empty grains H that have fallen into the immature grain conveyor 64 are conveyed to a second port (not shown in the drawings) provided in the depth direction of FIG. 1.

Hulls N and dust T having a relatively very light specific gravity pass through the upper winnowing path 62 and mix with the hulls N that have passed through the lower winnowing path 60 and are sent to a hull conveyor 72 disposed at an other end of the main winnowing path 44. The hull conveyor 72 has a hull conveyor trough 74 and a hull screw conveyor 76. The hull conveyor trough 74 is disposed along the longitudinal direction of the hulling apparatus 10 and has a substantially U-shape when seen in cross section, and an upper side thereof opens in a vertical direction of the hulling apparatus 10. The hull screw conveyor 76 is axially rotatable within a lower interior of the hull conveyor trough 74 around an axis by a driving force of a main motor (not shown in the drawings). At the hull conveyor 72, hulls N and dust T are carried by an air current (sorting wind) and conveyed as far as the terminal end of the main winnowing path 44 to be collected in the hull conveyor trough 74 and removed.

It should be noted that the hulls N and dust T that have fallen into the hull conveyor 72 are conveyed to a third port (not shown in the drawings) provided in the depth direction of FIG. 1, and thereafter discharged to outside of the hulling apparatus.

An air output port 78 is formed at an inner curved portion (above the husk conveyor 72) of the main winnowing path 44. A vertical duct that communicates with the curved portion of the main winnowing path 44 via the air output port 78 is provided at an inner side of the air output port 78. The blower 50 is disposed at a lower end of the duct 80. Further, an air outlet 82 is formed at a downstream side of the direction in which the blower 50 rotates. Accordingly, an air circulation passage is formed having the following flow: blower 50→air outlet 82→bottom of immature grain conveyor 64→bottom and side of whole grain conveyor 52→ventilation port 48→main winnowing path 44→air output port 78→duct 80→blower 50.

Figure 2B:
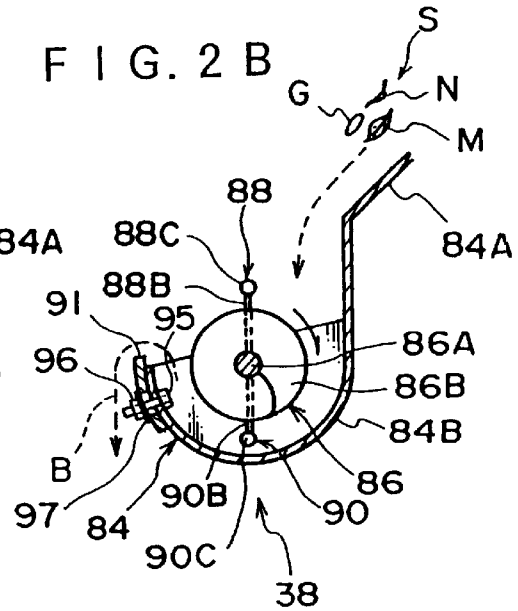
FIG. 2B is a cross-sectional view, cut along a right angle to the axial direction, illustrating the uniform disperser.
Figure 2A:
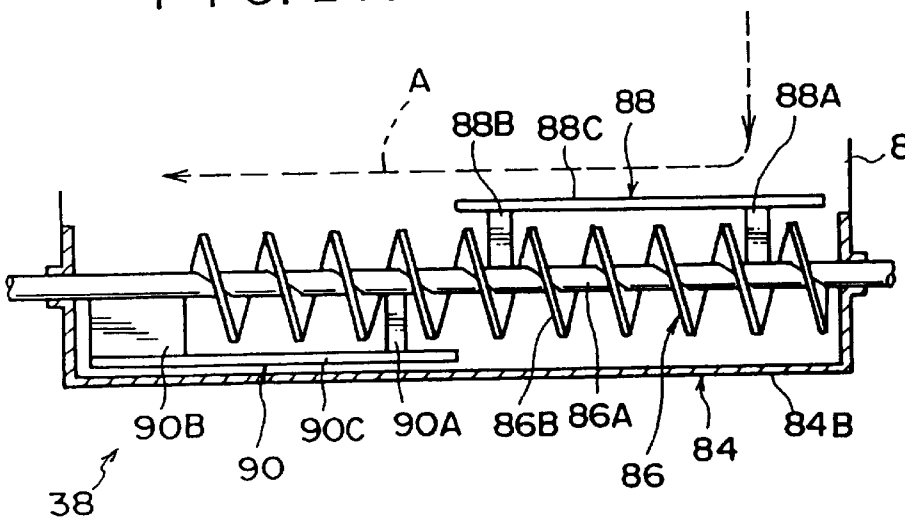
FIG. 2A is a cross-sectional view, cut along an axial direction, illustrating a uniform disperser pertaining to an essential portion of the hulling apparatus of the first aspect of the present invention.

In FIGS. 2A and 2B, a cross section of a uniform disperser pertaining to an essential part of the hulling apparatus of the first aspect of the present invention is expanded and illustrated therein. As shown in the drawings, the uniform disperser 38 is structured by a uniform disperser trough 84, a uniform disperser screw 86, and a pair of raking members 88 and 90. The uniform disperser trough 84 is formed in a lengthy configuration in the longitudinal direction of the hulling apparatus 10 (the width direction of the winnowing section 16) along the axes of the hulling rolls 28 and 30. The uniform disperser screw 86 is axially rotatable within the lower interior of the uniform disperser trough 84 around an axis by a driving force of a main motor (not shown in the drawings). The raking members 88 and 90 form a "raking means" integrated with the uniform disperser screw 86.

To explain each part in detail, the uniform disperser trough 84 is structured by a plate-configured receiving portion 84A and a trough portion 84B. The receiving portion 84A catches milling-processed grains S that flow down along the guide plate 36 and fall to the receiving portion 84A. The trough portion 84B is formed in a substantially semi-cylindrical configuration from a lower end of the receiving portion 84A. The uniform disperser trough 84 has a length spanning a substantially total width of the wide winnowing section 16 (see FIG. 3).

Further, the uniform disperser screw 86 is structured by a screw shaft 86A axially supported at both ends of the trough portion 84B and a helical screw 86B formed around at an outer periphery of the screw shaft 86A. When the screw shaft 86A receives a driving force of a main motor (not shown in the drawings) to rotate around an axis of the screw shaft 86A, the uniform disperser screw 86 uniformly disperses the milling-processed grains S and causes them to fall in the direction of a broken-line arrow B in FIG. 2B, as the milling-processed grains S are conveyed in the direction of a broken-line arrow A in FIG. 2A.

The raking member 88 is disposed at an upstream side of the direction in which the milling-processed grains S are conveyed, and is structured by a pair of stays 88A and 88B and a raking rod 88C. Proximal ends of the stays 88A and 88B are fixed at an outer peripheral surface of the screw shaft 86A, and distal ends of the same extend outward (i.e., away from the axis of the screw shaft 86A) in parallel to one another in a radial direction. The raking rod 88C is disposed parallel to the screw shaft 86A and spans across the distal ends of the stays 88A and 88B. It should be noted that the stays 88A and 88B are each formed in a plate configuration having a narrow width. Further, a distance from the axis of the screw shaft 86A to the outermost periphery of the raking rod 88C is set to be somewhat shorter than an inner circumferential radius of the trough portion 84B of the uniform disperser trough 84.

The raking member 90 is disposed at a downstream side of the direction in which the milling-processed grains S are conveyed, and is structured by a stay 90A, a raking plate 90B and a raking rod 90C. Proximal ends of the stay 90A and the raking plate 90B are fixed at an outer peripheral surface of the screw shaft 86A, and distal ends of the same extend outward (i.e., away from the axis of the screw shaft 86A) in parallel to one another in a radial direction. The raking rod 90C is disposed parallel to the screw shaft 86A and spans across the distal ends of the stay 90A and the raking plate 90B. The stay 90A is formed in a plate configuration having a narrow width, and the raking plate 90B disposed near a closed end of the trough portion 84B is formed in a plate configuration having a wide width. Further, a distance from the axis of the screw shaft 86A to the outermost periphery of the raking rod 90C is set to be somewhat shorter than an inner circumferential radius of the trough portion 84B of the uniform disperser trough 84.

Moreover, the raking members 88 and 90 are mounted in a state in which, when viewed in the axial direction of the uniform disperser screw 68, they are separated by a 180° phase.

Figure 3:
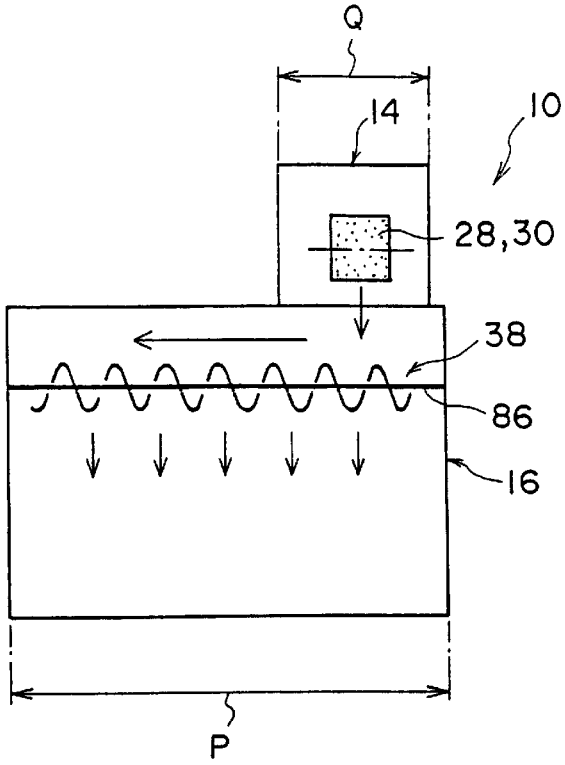
FIG. 3 is a diagram to describe an operation and effect when the uniform disperser of the first aspect is used.

A schematic structure of the hulling apparatus 10 is illustrated in FIG. 3. As shown in the drawing, a width direction dimension P of the winnowing section 16 (corresponding to a "winnowing width" in the present invention) is set to be quite larger than a width direction dimension Q of the hulling section 14 (corresponding to a "milling-processed grain discharge width" in the present invention). The uniform disperser 38 in the present aspect is directed toward a hulling apparatus of a structure having this dimensional relationship.

Figure 2C:
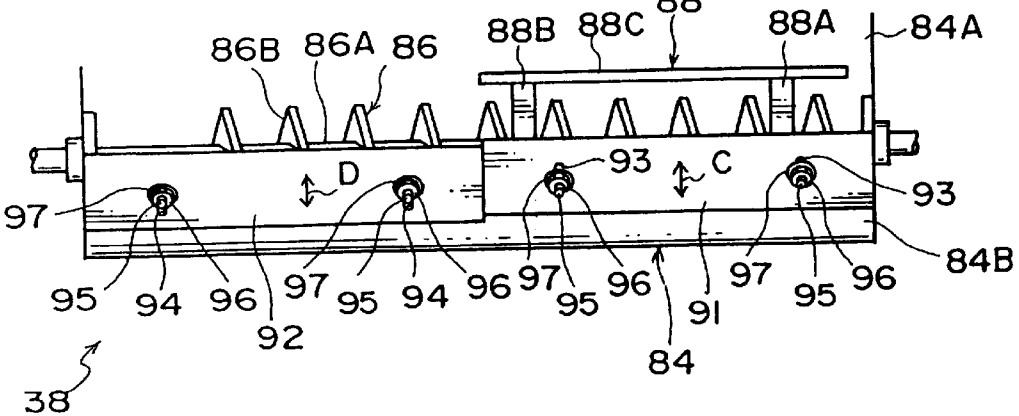
FIG. 2C is a cross-sectional view illustrating a structure of an accommodation plate mounted at the uniform disperser.

As illustrated in FIGS. 2B and 2C, a pair of adjustment plates 91 and 92 are provided at ends of the milling-processed grain discharge width of the uniform disperser trough 84 as "adjustment members" to make the edge direction thereof into the longitudinal direction. The adjustment plates 91 and 92 are formed as curved plates that curve along the curved surface of the trough portion 84B. A pair of slotted holes 93 and 94 is formed in the vicinity of longitudinal ends of each of the adjustment plates 91 and 92. The slotted holes 93 and 94 are formed slenderly in the width direction of the adjustment plates 91 and 92. Through-holes (round holes) for bolts are respectively formed at positions that overlap with the slotted holes 93 and 94 at the trough portion 84B side of the uniform disperser trough 84 to correspond to the slotted holes 93 and 94. Adjustment of height (adjustment of the amount that projects from the upper end of the trough portion 84B) is conducted by independently moving the adjustment plates 91 and 92 in the directions of arrows C and D (which are the longitudinal directions of the slotted holes 93 and 94, and correspond to a "direction that interrupts milling-processed grains spilling over from the uniform disperser trough" in the present invention) and fixing the adjustment plates 91 and 92 at adjustment positions by bolts 95, nuts 96 and washers 97. In the present aspect, the adjustment plate 91 disposed at the upstream side of the direction in which the milling-processed grains S are conveyed is adjusted so as to be somewhat higher than the adjustment plate 92 disposed at the downstream side of the direction in which the milling-processed grains are conveyed.

An operation and effect of the first aspect of the present invention will next be described.

At the hulling apparatus 10 having the structure described above, paddy rice M is cast into the paddy rice supply hopper 20 via the paddy rice supply hose 18 from a paddy rice storage tank (not shown in the drawings). At this time, the feed bulb 22 provided beneath the paddy rice supply hopper 20 is in a state of non-rotation (a closed state) until the amount of paddy rice M cast therein reaches a predetermined amount. When a predetermined amount of the paddy rice M is cast into the paddy rice supply hopper 20, a driving switch of the hulling apparatus 10 is turned on to rotate the feed bulb 22 at a predetermined rotational speed.

When the feed bulb 22 rotates, the paddy rice M is fed in accordance with the rotational speed of the feed bulb 22 and dropped onto the guide plate 24. The paddy rice M then flows down along the guide plate 24 to between the pair of hulling rolls 28 and 30 in the hulling chamber 26. Due to the slight difference in the rotational speeds of the hulling rolls 28 and 30, paddy rice M supplied to between the pair of hulling rolls 28 and 30 is milled at the time the grains pass through the gap between the hulling rolls 28 and 30, whereby husking processing (hulling) is carried out.

Milling-processed grains S subjected to the husking processing hit the guide plate 36 as they are, flow down along the guide plate 36 and fall toward the receiving portion 84A of the uniform disperser trough 84 of the uniform disperser 38. The milling-processed grains S caught by the receiving portion 84A flow down along the receiving portion 84A and into the trough portion 84B. As shown in FIG. 3, because the hulling section 14 is provided at an offset side of the winnowing section 16, the milling-processed grains S are fed locally to the upstream side of the trough portion 84B. Milling-processed grains S fed to the upstream conveyance direction are uniformly dispersed by the uniform disperser screw 86 while being conveyed in the width direction of the winnowing section 16 to spill over from the trough portion 84 and fall.

The milling-processed grains S that have been uniformly dispersed by the uniform disperser 38 fall as they are along the vertical winnowing path 42. By the operation of the blower 50, air is circulated along the air circulation passage having the following flow: blower 50→air outlet 82→bottom of immature grain conveyor 64→bottom and side of whole grain conveyor 52→ventilation port 48→main winnowing path 44→air output port 78→duct 80→blower 50. Therefore, by the air blasted through the ventilation port 48, the small grains K and the empty grains H (both immature grains), the husks N and the dust T, whose specific gravity is relatively light, are blown toward the main winnowing path 44, and a small amount of paddy rice M and a large amount of brown rice G, whose specific gravity is relatively heavy, fall into the whole grain conveyor 52 to be sorted.

The paddy rice M and the brown rice G that have flowed into the whole grain conveyor 52 are conveyed by the whole grain screw conveyor 56 toward the first port (not shown in the drawings) disposed in the depth direction of FIG. 1 and sent to a separately provided paddy rice and brown rice sorting apparatus (not shown in the drawings).

The immature grains (small grains K and empty grains H), the husks N and the dust T blown into the main winnowing path 44 by the air blasted through the ventilation port 48 are sorted by the partition wall 58. Namely, the husks N and dust T, whose specific gravity is relatively light pass through the upper winnowing path 62 and the immature grains (small grains K and empty grains H), whose specific gravity is relatively heavy, pass through the lower winnowing path 60. When the immature grains (small grains K and empty grains H) pass through the lower winnowing path 60, the immature grains fall by their own weight into the immature grain conveyor 64, which is in an opened state, to be sorted. Although a small amount of husks N may be mixed in with the immature grains (small grains K and empty grains H) passed through the lower winnowing path 60 by the force of the air blasted through the ventilation port 48, the husks N do not fall into the immature grain conveyor 64 because the specific weight of the husks N is light enough for them to pass through the lower winnowing path 60 without falling, so that they merge with the husks N and dust T that have passed through the upper winnowing path 62.

The immature grains (small grains K and empty grains H) that have flowed into the immature grain conveyor 64 are conveyed by the immature grain screw conveyor 68 toward the second port (not shown in the drawings) provided in the depth direction of FIG. 1.

The large amount of the husks N that have passed through the upper winnowing path 62 and the small amount of the husks N that have passed through the lower winnowing path 60 merge at the downstream side of the partition wall 58, and thereafter pass as they are through the curved portion of the main winnowing path 44 to be fed to the husk conveyor 72. The husks N that have flowed into the husk conveyor 72 are conveyed by the husk screw conveyor 76 to the third port provided in the depth direction of FIG. 1 and are discharged to the outside of the apparatus.

Further, due to the operation of the suction force of the blower 50 via the duct 80, a portion of the air current is outputted from the air output port 78 to the duct 80 and returned to the blower 50. The air returned thereto is supplied once again to the air outlet port 82 by the blower 50. In this manner, the series of processes according to the hulling apparatus 10 is completed.

As described above, the uniform disperser 38 having a length spanning the width direction of the winnowing section 16 is disposed between the hulling section 14 and the winnowing section 16. Milling-processed grains S that fall locally from the hulling section 14 are uniformly dispersed by the uniform disperser 38 and made to fall toward the vertical winnowing path of the winnowing section 16. Hence, the dropping density of the milling-processed grains S with respect to the air current (sorting wind) blasted from the ventilation port 48 can be equalized. As a result, the winnowing effect can be improved according to the invention of the present aspect.

Moreover, at the hulling apparatus 10, because the uniform disperser 38 is structured to include the lengthy uniform disperser trough 84 and the uniform disperser screw 86, uniform dispersion of the milling-processed grains S can be realized with a simple structure.

There is an alternative to the uniform disperser 38 in which, for example, a diffusion plate is provided to diffuse the milling-processed grains S by forcing the milling-processed grains S to flow down at an incline to thereby fall. However, because a coercive force (i.e., the coercive force produced by the uniform disperser screw 86 of the uniform disperser 38) to uniformly disperse the milling-processed grains S is not operative in this case, the density at which the milling-processed gains S are uniformly dispersed is low. Thus, one can infer the greatness of the winnowing effect in a case in which the uniform disperser 38 is used.

Further, because the pair of raking members 88 and 90 are provided on the uniform disperser screw 86 in the uniform disperser 38, when the uniform disperser screw 86 rotates around the axis thereof, the pair of raking members 88 and 90 also rotate integrally with the uniform disperser screw 86. As a result, the milling-processed grains S that have flowed into the uniform disperser trough 84, even milling-processed grains S that stop at the bottom of the inner periphery of the uniform disperser trough 84, can be raked out with great efficiency. Thus, the milling-processed grains S can be optimally prevented from stopping inside the uniform disperser trough 84.

In addition, when the uniform disperser 38 is structured to include the uniform disperser trough 84 and the uniform disperser screw 86, the part where the milling-processed grains S most easily stop is the end of the uniform disperser trough 84 at the downstream side of the direction in which the grains are conveyed. However, in the present aspect, the raking plate 90B is provided at the downstream side of the conveyance direction of the uniform disperser screw 86, so that stoppage of the milling-processed grains S at this end can be optimally prevented.

Further, because the raking members 88 and 90 are structured to include the raking rods 88C and 90C disposed parallel to the uniform disperser screw 86, milling-processed grains S that have flowed into the uniform disperser trough 84 can be raked out of the uniform disperser trough 84 with great efficiency, so that stoppage of the milling-processed grains S at the bottom of the inner periphery of the uniform disperser 84 can be optimally prevented.

Moreover, in the present aspect, adjustment plates 91 and 92 are provided that are capable of advancing toward and retreating from the direction that blocks milling-processed grains S spilling over from the uniform disperser trough 84 at at least the side of the uniform disperser trough 84 into which the milling-processed grains S flow. Therefore, the dropping amount of the milling-processed grains S at the milling-processed grains inflow side can be suppressed by advancing the adjustment plates 91 and 92 toward the damming direction. As a result, the milling-processed grains S can be evenly dispersed from the overall longitudinal direction of the uniform disperser trough 84 and caused to fall. Thus, the equalization effect can be improved.

Further, in the present aspect, because two adjustment plates 91 and 92 are used, adjustment operations can be carried out independently at the upstream side and downstream side of the direction in which the milling-processed grains S are conveyed. Consequently, precision of adjustment can be raised.

It should be noted that in the present aspect, a pair of raking members 88 and 90 is divided along the axial direction of the uniform disperser screw 86. However, the present invention is not limited to the same. The raking member may also be structured by a single raking rod and the raking plate 90B.

Figure 4:
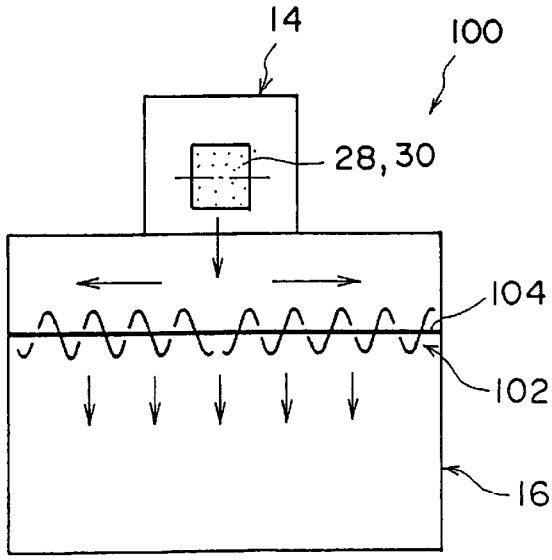
FIG. 4 is a diagram illustrating a structural aspect different from the structure illustrated in FIG. 3.

Further, in the present aspect, as shown in FIG. 3, the present invention is applied to the hulling apparatus 10 in which the hulling section 14 is disposed at one side above the winnowing section 16. However, the present invention is not limited to the same. As illustrated in FIG. 4, the present invention may also be applied to a hulling apparatus 100 in which the hulling section 14 is disposed at a width direction substantial center of the winnowing section 16. In this case, a uniform disperser screw 104 of a uniform disperser 102 conveys the milling-processed grains S in opposing directions, and it is preferable to mount the raking plate 90B of the present aspect at the both axial direction ends of the uniform disperser screw 104.

Moreover, in the present aspect, the raking members 88 and 90 that are each provided with the raking plate 90B and the raking rods 88C and 90C are used. However, the raking members 88 and 90 may be provided with at least the raking plate 90B, and at least one of the raking rods 88C/90C and raking rods having another structure. In addition, as long as the structure uses the rotation of the uniform disperser screw 86 to evenly disperse the milling-processed grains S that have flowed into the uniform disperser trough 84 and rake out the same with great efficiency, anything may be used.

Further, in the present invention, a pair of adjustment plates 91 and 92 is provided at the uniform disperser trough 84 ends at which the milling-processed grains are discharged. However, the present invention is not limited to the same. A single adjustment plate may also be used. Alternatively, a structure in which three or more adjustment plates are provided may also be used. In addition, because a sufficient effect can be obtained as long as there is the adjustment plate 91 that becomes the side at which the milling-processed grains S flow thereto, the adjustment plate 92 disposed at the downstream side of the conveyance direction may be omitted. Further, in the present aspect, the positions of the adjustment plates 91 and 92 are adjusted using the slotted holes 93 and 94. However, the present invention is not limited to the same. Employing a variety of adjustment mechanisms is possible, such as a structure that uses a sector gear or a structure that uses a guide rail and a positioning pin.

In the first aspect described above, there is a means for uniformly dispersing milling-processed grain, the means being disposed between a hulling section and a winnowing section and including a long uniform disperser trough having a longitudinal direction dimension substantially equal to a winnowing width of a winnowing section and a uniform disperser screw that is rotatable within the uniform disperser trough around an axis and that conveys in an axial direction milling-processed grains that are discharged from a hulling section and flow into the uniform disperser trough. Accordingly, the dropping density of milling-processed grains with respect to a sorting wind blasted at the winnowing section can be equalized. As a result, the present invention has an excellent effect in that winnowing efficiency can be improved.

Moreover, because the means for uniformly dispersing the milling-processed grains is structured to include the long uniform disperser trough and the uniform disperser screw, the present invention also has an excellent effect in that the means for uniformly dispersing milling-processed grains can be achieved with a simple structure.

Second Aspect

A second aspect of the present invention will next be described with reference to FIGS. 5, 6A and 6B. Parts shared in common with those of the first aspect are designated by the same reference numerals and description thereof will be omitted.

In the hulling apparatus 10 according to the present aspect, the width direction dimension of the winnowing section 16 (i.e., the milling-processed grain discharge width) is set to be quite larger than the width direction dimension of the hulling section (i.e., the winnowing section). For this reason, the uniform disperser 38 is provided in order to prevent the milling-processed grains S from flowing into the winnowing section 16 locally.

Figure 6B:
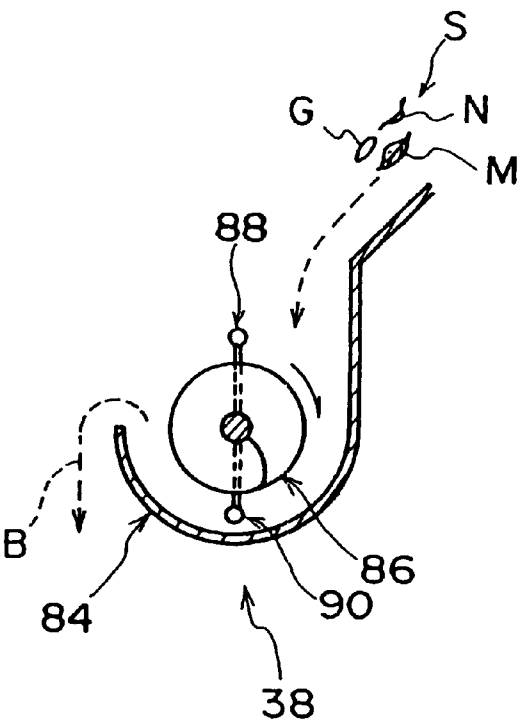
FIG. 6B is a cross-sectional view cut along a right angle to the axial direction, illustrating the uniform disperser.
Figure 6A:
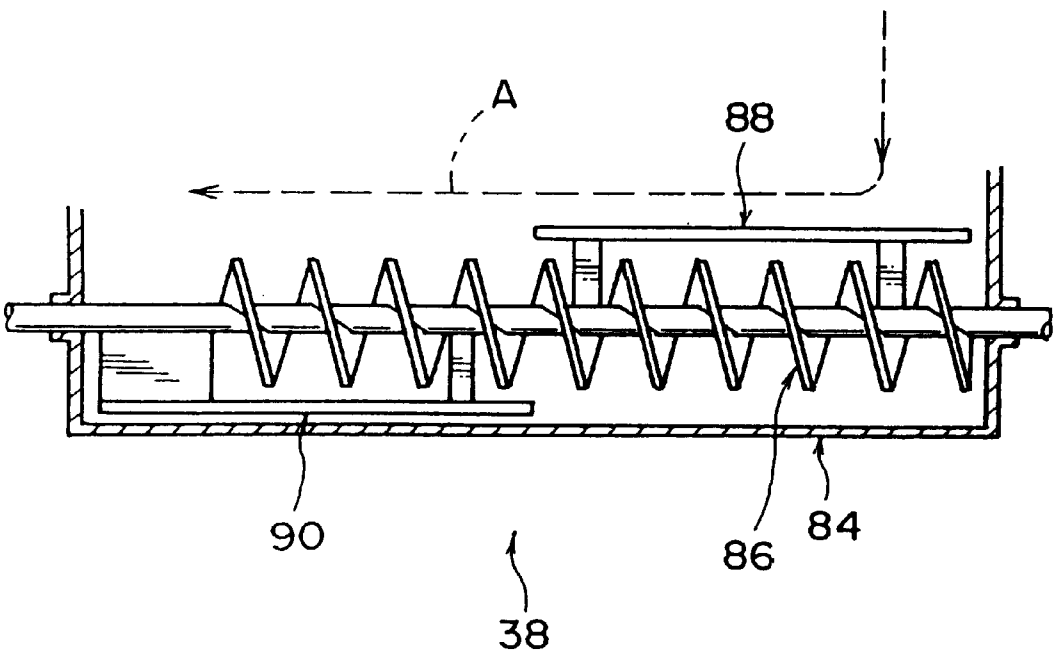
FIG. 6A is a cross-sectional view, cut along an axial direction, illustrating a uniform disperser.

As shown in FIGS. 6A and 6B, when the uniform disperser screw 86 is rotated around an axis thereof by receiving a driving force of a main motor (not shown in the drawings), the uniform disperser 38 uniformly disperses milling-processed grains in the direction of the broken-line arrow B in FIG. 6B, as the milling-processed grains are conveyed in the direction of the broken-line arrow A in FIG. A. Further, milling-processed grains S that have flowed into the uniform disperser trough 84, and even milling-processed grains S that stop at the inner peripheral bottom of the uniform disperser trough 84, are raked out of the uniform disperser trough 84 with great efficiency by the pair of raking members 88 and 90. Thus, the milling-processed grains S can be optimally prevented from stopping inside the uniform disperser trough 84.

Further, the whole grain conveyor 52 for sorting paddy rice M and brown rice G from the milling-processed rice S is provided below the vertical winnowing path 42. The whole grain conveyor 52 has the whole grain conveyor trough 54 and the whole grain screw conveyor 56. The whole grain conveyor trough 54 is disposed along the longitudinal direction of the hulling apparatus 10 (i.e., from the bottom of FIG. 5 toward the depth direction of the same) and has a substantial U-shape when seen in cross section, and an upper side thereof opens in a vertical direction of the hulling apparatus 10. The whole grain screw conveyor 56 is axially rotatable within the lower interior of the whole grain conveyor trough 54 around an axis by a driving force of a main motor (not shown in the drawings).

The immature grain conveyor 64 has the immature grain conveyor trough 66 and the immature grain screw conveyor 68. The immature grain conveyor trough 66 is disposed along the longitudinal direction of the hulling apparatus 10 and has a substantial U-shape when seen in cross section, and an upper side thereof has an opening 94. The immature grain screw conveyor 68 is axially rotatable within the lower interior of the immature grain conveyor trough 66 around an axis by a driving force of a main motor (not shown in the drawings).

Here, the open/close valve 70 is provided at the opening 94 of the immature grain conveyor trough 66 in the immature grain conveyor 64 as an "open/close means" to open up and close off the opening 94. The open/close valve 70 is rotatable around an axis 96. A solid line in FIG. 5 illustrates a state in which the open/close valve 70 is opened, and a two-dot chain line in FIG. 5 indicates a state in which the open/close valve 70 is closed.

In the present aspect, the opening 92 of the whole grain conveyor trough 54 in the whole grain conveyor 52 described previously and the opening 94 of the immature grain trough 66 in the immature grain conveyor 64 are mutually connected by a winnowing path 98 having an ascending pitch, such that the position of the opening 94 is higher than the position of the opening 92.

An operation and effect of the present aspect will next be described.

For a market in which sorting of immature grains is necessary, the open/close valve 70 is in an opened state. Accordingly, the opening 94 of the immature grain conveyor trough 66 in the immature grain conveyor 64 is in an opened state.

Paddy rice M is cast into the paddy rice supply hopper 20 via the paddy rice supply hose 18 from a paddy rice storage tank (not shown in the drawings). At this time, the feed bulb 22 provided beneath the paddy rice supply hopper 20 is in a state of non-rotation (a closed state) until the amount of paddy rice M cast therein reaches a predetermined amount. When a predetermined amount of the paddy rice M is cast into the paddy rice supply hopper 20, a driving switch of the hulling apparatus 10 is turned on to rotate the feed bulb 22 at a predetermined rotational speed.

When the feed bulb 22 rotates, the paddy rice M is fed in accordance with the rotational speed of the feed bulb 22 and dropped onto the guide plate 24. The paddy rice M then flows down along the guide plate 24 to between the pair of hulling rolls 28 and 30 in the hulling chamber 26. Due to the slight difference in the rotational speeds of the hulling rolls 28 and 30, paddy rice M supplied to between the pair of hulling rolls 28 and 30 is milled at the time the grains pass through the gap between the hulling rolls 28 and 30, whereby husking processing (hulling) is carried out.

Milling-processed grains S subjected to the husking processing hit the guide plate 36 as they are, flow down along the guide plate 36 and fall toward the receiving portion 84A of the uniform disperser trough 84 of the uniform disperser 38. The milling-processed grains S caught by the receiving portion 84A flow down along the receiving portion 84A and into the trough portion 84B. As shown in FIG. 3, because the hulling section 14 is provided at an offset side of the winnowing section 16, the milling-processed grains S are fed locally to the upstream side of the trough portion 84B. Milling-processed grains S fed to the upstream conveyance direction are uniformly dispersed by the uniform disperser screw 86 while being conveyed toward the width direction of the winnowing section 16 to spill over from the trough portion 84 and fall.

The milling-processed grains S that have been uniformly dispersed by the uniform disperser 38 fall as they are along the vertical winnowing path 42. By the operation of the blower 50, air is circulated along the air circulation passage having the following flow: blower 50→air outlet 82→bottom of immature grain conveyor 64→bottom and side of whole grain conveyor 52→ventilation port 48→main winnowing path 44→air output port 78→duct 80→blower 50. Therefore, by the air blasted through the ventilation port 48, the small grains K and the empty grains H (both immature grains), the husks N and the dust T, whose specific gravity is relatively light, are blown toward the main winnowing path 44, and a small amount of paddy rice M and a large amount of brown rice G, whose specific gravity is relatively heavy, fall into the whole grain conveyor 52 to be sorted.

Figure 5:
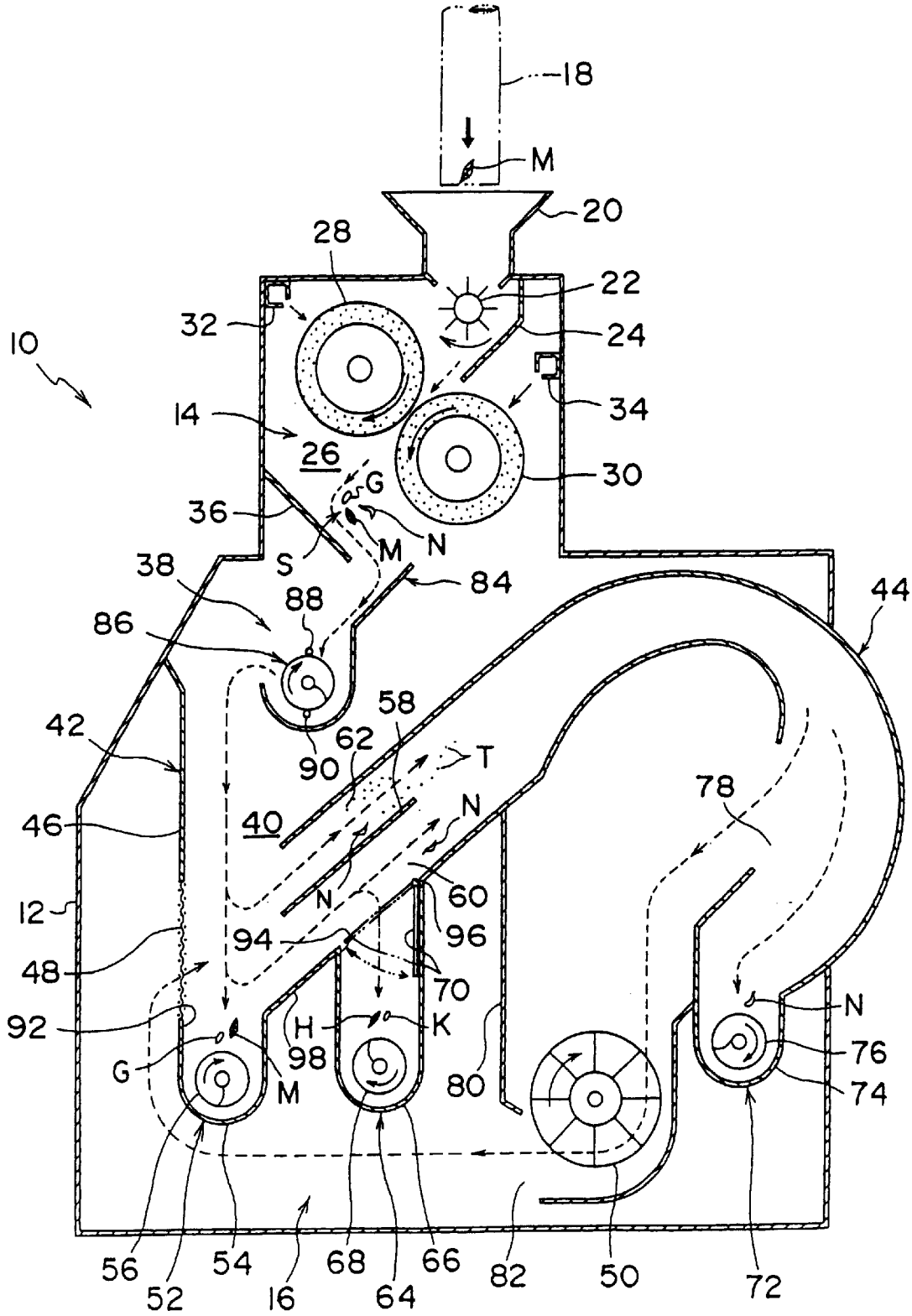
FIG. 5 is a longitudinal cross-sectional view schematically illustrating an overall structure of a hulling apparatus pertaining to a second aspect of the present invention.

The paddy rice M and the brown rice G that have flowed into the whole grain conveyor 52 are conveyed by the whole grain screw conveyor 56 toward the first port (not shown in the drawings) disposed in the depth direction of FIG. 5 and set to a separately provided paddy grain and brown rice sorting apparatus (not shown in the drawings).

The immature grains (small grains K and empty grains H), the husks N and the dust T blown into the main winnowing path 44 by the air blasted through the ventilation port 48 are sorted by the partition wall 58. Namely, the husks N and dust T, whose specific gravity is relatively light pass through the upper winnowing path 62 and the immature grains (small grains K and empty grains H), whose specific gravity is relatively heavy, pass through the lower winnowing path 60. When the immature grains (small grains K and empty grains H) pass through the lower winnowing path 60, the immature grains fall by their own weight into the immature grain conveyor 64, which is in an opened state, to be sorted. Although a small amount of husks N may be mixed in with the immature grains (small grains K and empty grains H) passed through the lower winnowing path 60 by the force of the air blasted through the ventilation port 48, the husks N do not fall into the immature grain conveyor 64 because the specific weight of the husks N is light enough for them to pass through the lower winnowing path 60 without falling, so that they merge with the husks N and dust T that have passed through the upper winnowing path 62.

The immature grains (small grains K and empty grains H) that have flowed into the immature grain conveyor 64 are conveyed by the immature grain screw conveyor 68 toward the second port (not shown in the drawings) provided in the depth direction of FIG. 5.

The large amount of the husks N that have passed through the upper winnowing path 62 and the small amount of the husks N that have passed through the lower winnowing path 60 merge at the downstream side of the partition wall 58, and thereafter pass as they are through the curved portion of the main winnowing path 44 to be fed to the husk conveyor 72. The husks N that have flowed into the husk conveyor 72 are conveyed by the husk screw conveyor 76 to the third port provided in the depth direction of FIG. 5 and are discharged to the outside of the apparatus.

Further, due to the operation of the suction force of the blower 50 via the duct 80, a portion of the air current is outputted from the air output port 78 to the duct 80 and returned to the blower 50. The air returned thereto is supplied once again to the air outlet port 82 by the blower 50. In this manner, the series of processes according to the hulling apparatus 10 is completed.

For a market in which sorting of immature grains is unnecessary, the open/close valve 70 is in a closed state. Accordingly, the opening 94 of the immature grain conveyor trough 66 in the immature grain conveyor 64 is in a closed state.

The process is basically the same of that of the case described earlier. Here, description will be given only of portions relating to the immature grain conveyor 64 that are different from the case described earlier.

In this case, when the sorting wind is blasted to the milling-processed grains S that have been subjected to husking processing, the brown rice G and the paddy rice M that are whole grains and have a relatively heavy specific gravity fall toward the opening 92 of the whole grain conveyor trough 54 in the whole grain conveyor 52 and flow down to an interior thereof. At this time, because the small grains K and the empty grains H that are immature grains have a specific gravity that is lighter than that of the whole grains, the immature grains pass through the opening 92 of the whole grains conveyor trough 54, but fall of their own weight toward the opening 94 of the immature grain trough 66 in the immature grain conveyor 64. However, because the opening 94 of the immature grain conveyor trough 66 is closed by the open/close valve 70, the immature grains fall onto the open/close valve 70.

Here, in the present aspect, because the opening 92 of the whole grain conveyor trough 54 and the opening 94 of the immature grain conveyor trough 66 are mutually connected by the winnowing path 98 having an ascending pitch, immature grains that have fallen onto the open/close valve 70 flow down along the winnowing path 98 and fall toward the opening 92 of the whole grain conveyor trough 54 to merge with the whole grains. Accordingly, sorting of the immature grains becomes selected.

In this manner, in the present aspect, the opening 92 of the whole grain conveyor trough 54 in the whole grain conveyor 52 and the opening 94 of the immature grain trough 66 in the immature grain conveyor 64 are mutually connected by the winnowing path 98 of an ascending pitch, such that the position of the opening 94 is higher than the position of the opening 92. Moreover, the open/close valve 70 for opening and closing the opening 94 is provided at the opening 94 of the immature grain conveyor 64. Therefore, it becomes possible to alter the set-up of the immature grain conveyor 64 in accordance with whether or not sorting the immature grains is necessary or unnecessary.

Further, in the hulling apparatus 10 pertaining to the present aspect, because it becomes unnecessary to have an illogical procedure in which whole grains and immature grains that have been respectively separated are placed together once more at a later point in time, sorting efficiency can be improved.

Moreover, in the hulling apparatus 10 pertaining to the present aspect, because it is possible to determine the necessity of sorting the immature grains in advance, when the hulling apparatus 10 pertaining to the present aspect is provided for a market in which the sorting of immature grains is unnecessary, it becomes possible to present the apparatus to the market in a state in which the immature grain screw conveyor 68, pulleys belonging thereto and accessory parts such as bearings that must conventionally be provided at the immature grain conveyor 64 have been removed. Hence, the hulling apparatus 10 of the present aspect contributes largely to cost reduction.

In the present aspect, a structure has been described in which the opening 94 of the immature grain conveyor trough 66 is opened and closed by the open/close valve 70 being moved around the axis 96 to be opened and closed. However, the present invention is not limited to the same. A structure in which the opening 94 of the immature grain conveyor trough 66 is opened and closed by the open/close valve being slidably moved may also be employed.

As described above, the opening 92 of the whole grain conveyor trough 54 in the whole grain conveyor 52 and the opening 94 of the immature grain trough 66 in the immature grain conveyor 64 are mutually connected by the winnowing path 98 of an ascending pitch, such that the position of the opening 94 is higher than the position of the opening 92. Moreover, the open/close valve 70 for opening and closing the opening 94 is provided at the opening 94 of the immature grain conveyor 64. Therefore, the hulling apparatus pertaining to the present invention has an excellent effect in that it becomes possible to alter the set-up of the immature grain conveyor 64 in accordance with whether or not sorting the immature grains is necessary or unnecessary, and thus increase the marketability of the apparatus.

Further, according to the hulling apparatus pertaining to the present invention, an excellent effect can be obtained in that sorting efficiency can be improved because it becomes unnecessary to have an illogical procedure in which whole grains and immature grains that have been respectively separated are placed together once more at a later point in time.

Moreover, according to the hulling apparatus pertaining to the present invention, an excellent effect can be obtained in that, because it is possible to determine the necessity of sorting the immature grains in advance, when the hulling apparatus 10 pertaining to the present aspect is provided for a market in which the sorting of immature grains is unnecessary, it becomes possible to present the apparatus to the market in a state in which the immature grain screw conveyor 68, pulleys belonging thereto and accessory parts such as bearings that must conventionally be provided at the immature grain conveyor 64 have been removed. Hence, the hulling apparatus 10 of the present aspect contributes to cost effectiveness.

Third Aspect

Figure 7:
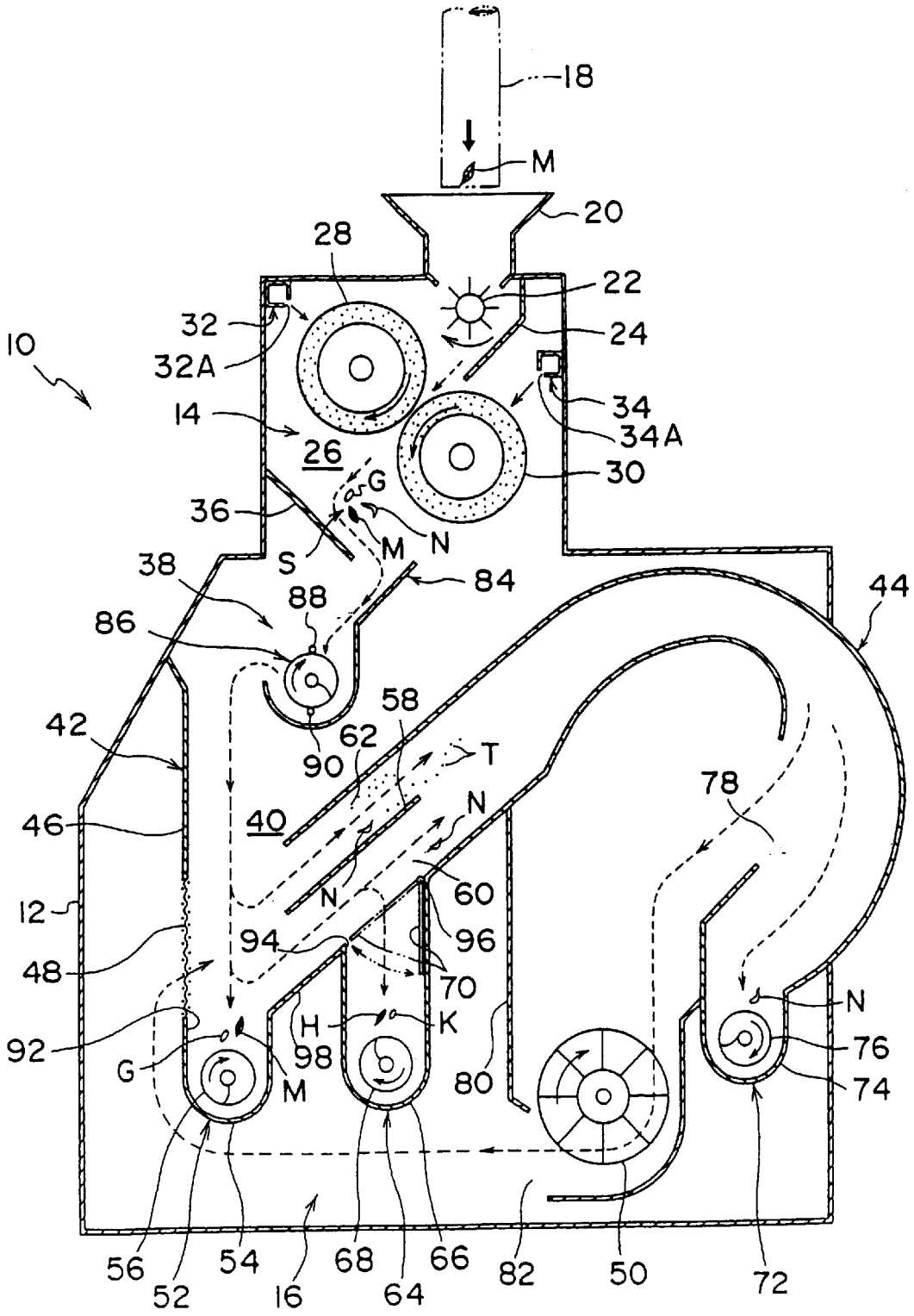
FIG. 7 is a longitudinal sectional view schematically illustrating an overall structure of a hulling apparatus pertaining to a third aspect of the present invention.
Figure 8B:
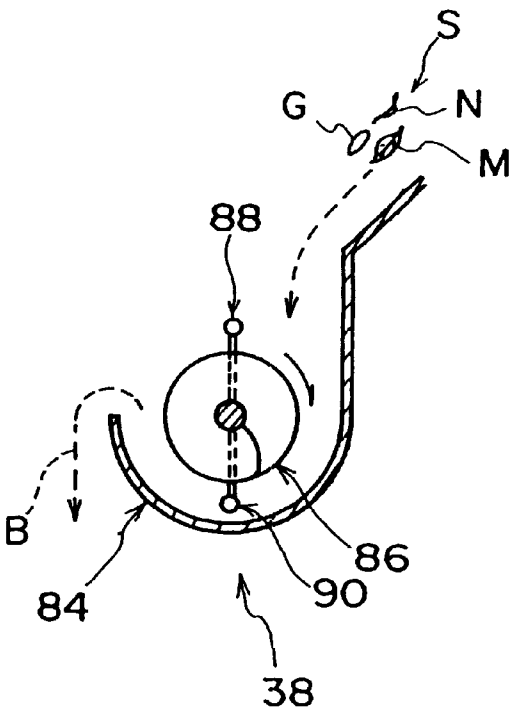
FIG. 8B is a cross-sectional view, cut along a right angle to the axial direction, illustrating the uniform disperser.
Figure 8A:
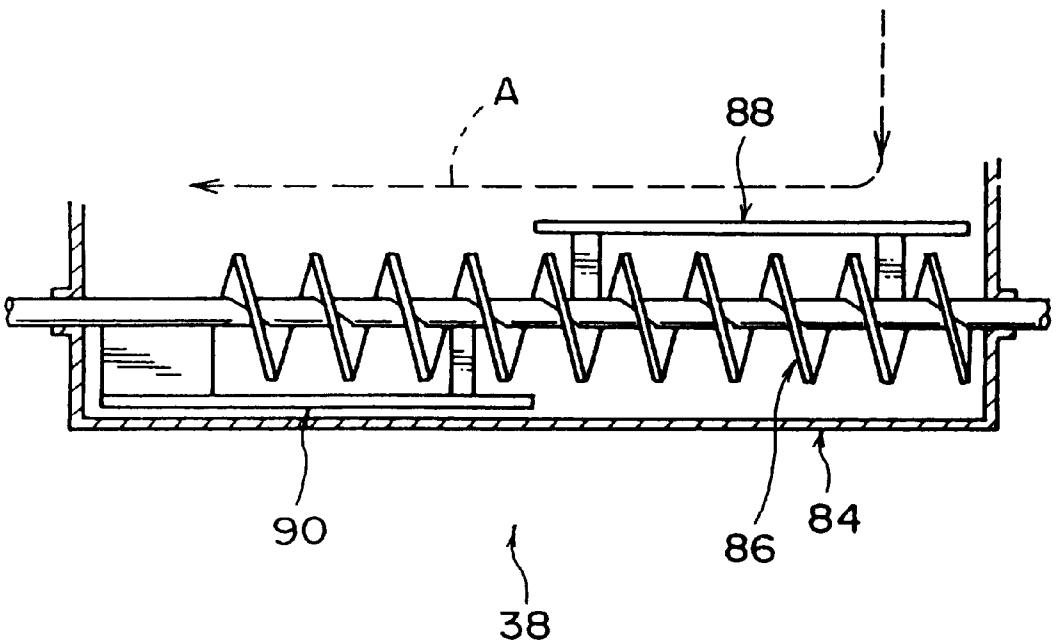
FIG. 8A is a cross-sectional view cut along an axial direction, illustrating a uniform disperser.

The open/close valve 70 to open up and close off the opening 94 is provided at the opening 94 of the immature grain conveyor trough 66 in the immature grain conveyor 64. The open/close valve 70 is rotatable around the axis 96. A solid line in FIG. 7 illustrates a state in which the open/close valve 70 is opened, and a two-dot chain line in FIG. 7 indicates a state in which the open/close valve 70 is closed. The opening 92 of the whole grain conveyor trough 54 in the whole grain conveyor 52 described previously and the opening 94 of the immature grain trough 66 in the immature grain conveyor 64 are mutually connected by the winnowing path 98 of an ascending pitch, such that the position of the opening 94 is higher than the position of the opening 92. In the immature grain conveyor 64, only the small grains K and the empty grains H that are immature grains are sorted from milling-processed grains S by the partition wall 58 and made to fall from the small grains K, the empty grains H and the husks N that pass through the lower winnowing path 60.

Figure 10:
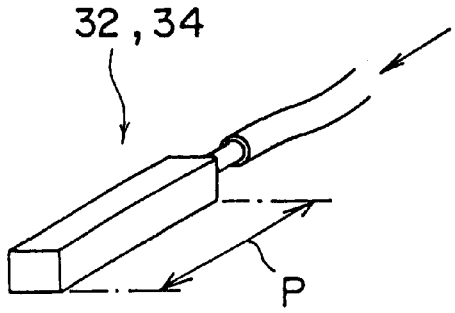
FIG. 10 is a perspective view of an overall configuration of the first air nozzle and the second air nozzle.

The first air nozzle 32 formed in a long configuration along the axis of the hulling roll 28 and having a slit hole 32A is disposed in the vicinity of the hulling roll 28 that is situated toward the left in FIG. 7 (i.e., at the upper left-hand corner of the casing 12 in FIG. 7). Similarly, the second air nozzle 34 formed in a long configuration along the axis of the hulling roll 30 and having a slit hole 34A is disposed in the vicinity of the hulling roll 30 that is situated toward the right in FIG. 7 (i.e., near the guide plate 24). The slit hole 32A is disposed in parallel so as to face a surface of the hulling roll 28, and the slit hole 34A is disposed in parallel so as to face a surface of the hulling roll 30. Further, longitudinal direction dimensions P (see FIG. 10) of the first air nozzle 32 and the second air nozzle 34 are set to be substantially the same as those of the hulling rolls 28 and 30. It should be noted that both longitudinal direction ends of the first air nozzle 32 and the second air nozzle 34 are closed.

Figure 9:
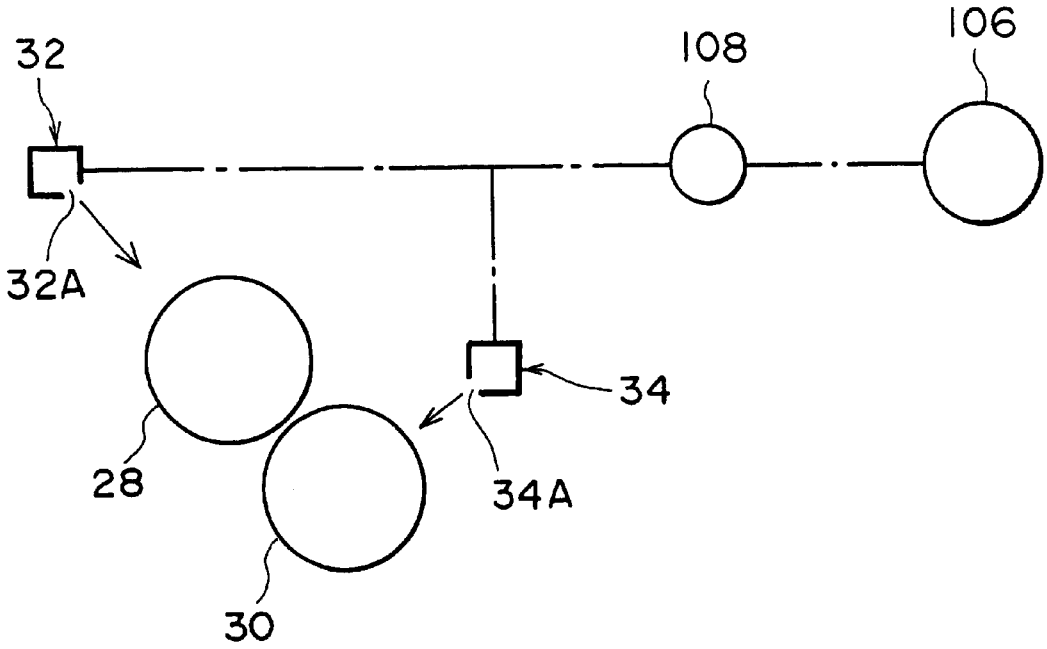
FIG. 9 is a structural diagram illustrating an air supply system of a first air nozzle and a second air nozzle.

As illustrated in FIG. 9, the first air nozzle 32 and the second air nozzle 34 are connected to a compressor 106. Moreover, an electromagnetic bulb 108 is intervened as an "open/close bulb" between the compressor 106 and the first and second air nozzles 32 and 34. The compressor 106 and the electromagnetic bulb 108 are connected to a controller (a "control means", not shown in the drawings), whereby the action of each is controlled by the controller.

An operation and effect of the present aspect will next be described.

At the hulling apparatus 10 having the structure described above, paddy rice M is cast into the paddy rice supply hopper 20 via the paddy rice supply hose 18 from a paddy rice storage tank (not shown in the drawings). At this time, the feed bulb 22 provided beneath the paddy rice supply hopper 20 is in a state of non-rotation (a closed state) until the amount of paddy rice M cast therein reaches a predetermined amount. When a predetermined amount of the paddy rice M is cast into the paddy rice supply hopper 20, a driving switch of the hulling apparatus 10 is turned on to rotate the feed bulb 22 at a predetermined rotational speed.

When the feed bulb 22 rotates, the paddy rice M is fed in accordance with the rotational speed of the feed bulb 22 and dropped onto the guide plate 24. The paddy rice M then flows down along the guide plate 24 to between the pair of hulling rolls 28 and 30 in the hulling chamber 26. Due to the slight difference in the rotational speeds of the hulling rolls 28 and 30, paddy rice M supplied to between the pair of hulling rolls 28 and 30 is milled at the time the grains pass through the gap between the hulling rolls 28 and 30, whereby husking processing (hulling) is carried out.

Milling-processed grains S subjected to the husking processing hit the guide plate 36 as they are, flow down along the guide plate 36 and fall toward the receiving portion 84A of the uniform disperser trough 84 of the uniform disperser 38. At this time, because the hulling section 14 is provided at an offset side with respect to the width direction of the winnowing section 16, the milling-processed grains S are fed locally to the upstream side of the trough portion 84B. Milling-processed grains S fed to the upstream conveyance direction are uniformly dispersed by the uniform disperser screw 86 while being conveyed toward the width direction of the winnowing section 16 to spill over from the trough portion 84 and fall.

The milling-processed grains S that have been uniformly dispersed by the uniform disperser 38 fall as they are along the vertical winnowing path 42. By the operation of the blower 50, air is circulated along the air circulation passage having the following flow: blower 50→air outlet 82→bottom of immature grain conveyor 64→bottom and side of whole grain conveyor 52→ventilation port 48→main winnowing path 44→air output port 78→duct 80→blower 50. Therefore, by the air blasted through the ventilation port 48, the small grains K and the empty grains H (both immature grains), the husks N and the dust T, whose specific gravity is relatively light, are blown toward the main winnowing path 44, and a small amount of paddy rice M and a large amount of brown rice G, whose specific gravity is relatively heavy, fall into the whole grain conveyor 52 to be sorted.

The paddy rice M and the brown rice G that have flowed into the whole grain conveyor 52 are conveyed by the whole grain screw conveyor 56 toward the first port (not shown in the drawings) disposed in the depth direction of FIG. 7 and set to a separately provided paddy grain and brown rice sorting apparatus (not shown in the drawings).

The immature grains (small grains K and empty grains H), the husks N and the dust T blown into the main winnowing path 44 by the air blasted through the ventilation port 48 are sorted by the partition wall 58. Namely, the husks N and dust T, whose specific gravity is relatively light pass through the upper winnowing path 62 and the immature grains (small grains K and empty grains H), whose specific gravity is relatively heavy, pass through the lower winnowing path 60. When the immature grains (small grains K and empty grains H) pass through the lower winnowing path 60, the immature grains fall by their own weight into the immature grain conveyor 64, which is in an opened state, to be sorted. Although a small amount of husks N may be mixed in with the immature grains (small grains K and empty grains H) passed through the lower winnowing path 60 by the force of the air blasted through the ventilation port 48, the husks N do not fall into the immature grain conveyor 64 because the specific weight of the husks N is light enough for them to pass through the lower winnowing path 60 without falling, so that they merge with the husks N and dust T that have passed through the upper winnowing path 62.

The immature grains (small grains K and empty grains H) that have flowed into the immature grain conveyor 64 are conveyed by the immature grain screw conveyor 68 toward the second port (not shown in the drawings) provided in the depth direction of FIG. 7.

The large amount of the husks N that have passed through the upper winnowing path 62 and the small amount of the husks N that have passed through the lower winnowing path 60 merge at the downstream side of the partition wall 58, and thereafter pass as they are through the curved portion of the main winnowing path 44 to be fed to the husk conveyor 72. The husks N that have flowed into the husk conveyor 72 are conveyed by the husk screw conveyor 76 to the third port provided in the depth direction of FIG. 7 and are discharged to the outside of the apparatus.

Further, due to the operation of the suction force of the blower 50 via the duct 80, a portion of the air current is outputted from the air output port 78 to the duct 80 and returned to the blower 50. The air returned thereto is supplied once again to the air outlet port 82 by the blower 50. In this manner, the series of processes according to the hulling apparatus 10 is completed.

When sorting of the immature grains is unnecessary, the open/close valve 70 is closed. Accordingly, the opening 94 of the immature grain conveyor trough 66 in the immature grain conveyor 64 is closed off. The immature grains that have passed through the opening 92 of the whole grain conveyor trough 54 fall of their own weight, flow down onto the winnowing path 98 and fall toward the opening 92 of the whole grain conveyor trough 54 to merge with the whole grains.

Here, when the hulling rolls 28 and 30 are used over a long period of time, the rubber layer on the surfaces on the hulling rolls 28 and 30 become heated, whereby the hardness of the rubber is lowered. However, in the hulling apparatus 10 pertaining to the present aspect, because the first air nozzle 32 and the second air nozzle 32 are provided in the vicinity of the positions at which the hulling rolls 28 and 30 are disposed, the rubber layers of the hulling rolls 28 and 30 are effectively cooled by compressed air blasted from the corresponding first and second air nozzles 32 and 34.

Specifically, compressed air is supplied to the first and second air nozzles 32 and 34 by an action of the compressor 106 when the electromagnetic bulb 108 has been opened by the controller (not shown in the drawings). Accordingly, compressed air is blasted from the slit hole 32A of the first air nozzle 32 toward the rubber layer of the surface of the hulling roll 28, and compressed air is blasted from the slit hole 34A of the second air nozzle 34 toward the rubber layer of the surface of the hulling roll 30. Thus, the rubber layer of the surfaces of the hulling rolls 28 and 30 receive compressed air and are evenly cooled.

Consequently, the rubber hardness of the hulling rolls 28 and 30 is highly maintained. As a result, hulling efficiency and durability of the hulling rolls 28 and 30 can be improved according to the present aspect.

Further, in the hulling apparatus 10 pertaining to the present aspect, because an electromagnetic bulb 108 is provided between the compressor 106 and the first and second air nozzles 32 and 34, opening and closing of the electromagnetic bulb 108 can controlled appropriately and it becomes possible, for example, to intermittently blast the compressed air from the first and second air nozzles 32 and 34. Consequently, the hulling rolls 28 and 30 can be efficiently cooled while adjusting an amount of the air by controlling the compressed air to blast intermittently.

Although it might be possible to provide a blower having a motor or the purpose of cooling the hulling rolls 28 and 30, such a structure would become complicated and controlling the drive for effective cooling would be difficult. However, in the hulling apparatus 10 pertaining to the present aspect, the first air nozzle 1 and the second air nozzle 2 have longitudinal direction dimensions that are the same as those of the hulling rolls 28 and 30, and also have the slit holes 32A and 34A that face the roll surfaces of the hulling rolls 28 and 30. Therefore, the hulling rolls 28 and 30 can be effectively cooled by a simple structure.

Further, according to the hulling apparatus 10 pertaining to the present aspect, compressed air blasted from the first and second air nozzles 32 and 34 can be used as an air supply source of the blower 50 having a function to eliminate particulate dust coming from the hulling rolls 28 and 30. Consequently, particulate dust removal performance can be improved.

Although the first and second air nozzles 32 and 34 are used in the present aspect to cool the hulling rolls 28 and 30, it should be noted that the present invention is not limited to the same. As long as the structure is one having a roll cooling means to cool the hulling rolls by blasting air onto the rolls, any such structure may be suitable used.

Further, although the slit holes 32A and 34A are formed in the first and second air nozzles 32 and 34 in the present aspect, the present invention is not limited to the same. A structure in which a plurality of air emission holes (e.g., round holes or the like) are formed at equidistant intervals may also be suitable used.

Moreover, although the cross-sectionally rectangular first and second air holes 32 and 34 are used in the present aspect, the present invention is not limited to the same. Air nozzles structured by a pipe material such a round pipe may also be used.

As described above, the hulling apparatus pertaining to the present invention has a roll cooling means, disposed in the vicinity of the positions at which the hulling rolls are disposed, to cool the hulling rolls by blasting air onto the hulling rolls. Thus, the rubber hardness of the hulling rolls can be highly maintained. As a result, the hulling apparatus of the present invention has an excellent effect in that hulling efficiency and hulling roll durability can be improved.

What is claimed is:

1. A hulling apparatus comprising:

(A) a hulling section configured to receive, husk, and discharge paddy rice as milling-processed grains in a flow having a milling-processed grain discharge width;

(B) a winnowing section disposed below the hulling section and configured to receive and winnow the milling-processed grains to select specific grains from the milling-processed grains, said winnowing section comprising a winnowing path having a winnowing width perpendicular to a winnowing direction, which width is wider than the milling-processed grain discharge width; and (C) a uniform disperser disposed between the hulling section and the winnowing section and comprising: (i) a uniform disperser trough for receiving the milling-processed grains from the hulling section and discharging the milling-processed grains uniformly to the winnowing section, said uniform disperser trough having a longitudinal axis parallel to the winnowing width and having a longitudinal length substantially the same as the winnowing width; and (ii) a uniform disperser screw axially rotatable within a lower interior of the uniform disperser trough to convey in the axial direction the milling-processed grains received from the hulling section while discharging the milling-processed grains from the uniform disperser trough to the winnowing section in a flow along the uniform disperser trough.

2. The hulling apparatus according to claim 1, wherein the uniform disperser has a raking element to rake milling-processed grains that flow into the uniform disperser trough.

3. The hulling apparatus according to claim 2, wherein the raking element has a raking plate disposed at a downstream side of a conveyance direction of the uniform disperser screw and integrated with the uniform disperser screw.

4. The hulling apparatus according to claim 3, wherein the raking element includes a raking rod disposed parallel to the uniform disperser screw at the downstream side of the conveyance direction of the uniform disperser screw and integrated with the raking plate.

5. The hulling apparatus according to claim 2, wherein the raking element has a raking rod disposed parallel to the uniform disperser screw at an upstream side of the conveyance direction of the uniform disperser screw and integrated with the uniform disperser screw.

6. The hulling apparatus according to claim 1, wherein the apparatus has an adjustment element provided at the uniform disperser trough, the adjustment element being adjustable to block milling-processed grains that fall from the uniform disperser trough.

7. The hulling apparatus according to claim 6, wherein the adjustment element has a pair of adjustment members, one of the pair being disposed at an upstream side of the uniform disperser screw and the other of the pair being disposed at a downstream side of the uniform disperser screw, with the adjustment members being adjustable independent of one another.

8. A hulling apparatus comprising:

(A) a hulling section configured to receive, husk, and discharge paddy rice as milling-processed grains; and (B) a winnowing section disposed below the hulling section and comprising: (i) a whole grain conveyor with a whole grain conveyor trough to select whole grains from the milling-processed grains by winnowing, (ii) an immature grain conveyor with an immature grain conveyor trough to select immature grains from the milling-processed grains by winnowing, (iii) a winnowing path being sloped upward along a stream of grains and having an opening connected to the whole grain conveyor and an opening connected to the immature grain conveyor, wherein a position of the opening to the immature grain conveyor trough is higher than a position of the opening to the whole grain conveyor trough, and (iv) an open/close device to open and close the opening to the immature grain conveyor, provided at the opening of the immature grain conveyor trough.

9. The hulling apparatus according to claim 8, wherein the open/close device has an open/close valve.

10. The hulling apparatus according to claim 9, wherein the open/close device has an axis, with the open/close valve being pivotable around the axis.

11. A hulling apparatus comprising:

(A) a hulling section comprising: (i) a pair of hulling rolls for husking paddy rice, said hulling rolls disposed parallel to each other with a gap therebetween, to which gap paddy rice is supplied, and husked paddy rice is discharged from the hulling rolls as milling-processed grins, and (ii) a roll-cooling device to cool the hulling rolls by blowing air onto an outer surface of the hulling rolls; and (B) a winnowing section disposed below the hulling section, for selecting specific grains from the milling-processed grains by winnowing the milling-processed grains received from the hulling section.

12. The hulling apparatus according to claim 11, wherein the hulling rolls are rotatable at mutually different rotational speeds.

13. The hulling apparatus according to claim 11, wherein a rubber layer is formed at a surface of the husking rolls.

14. The hulling apparatus according to claim 11, wherein the roll cooling device is disposed at a vicinity of the hulling rolls.

15. The hulling apparatus according to claim 11, wherein the roll-cooling device has air nozzles to blow cooling air to the surfaces of the hulling rolls.

16. The hulling apparatus according to claim 15, wherein the air nozzles are provided in a vicinity of the hulling rolls.

17. The hulling apparatus according to claim 16, wherein the roll-cooling device has a compressor to feed cooling air to the air nozzles.

18. The hulling apparatus according to claim 17, wherein an open/close bulb is provided between the compressor and the air nozzles.

19. The hulling apparatus according to claim 15, wherein the air nozzles have a longitudinal direction dimension substantially equal to a roll width of the hulling rolls.

20. The hulling apparatus according to claim 15, wherein the air nozzles have slit holes that oppose outer peripheral surfaces of the hulling rolls.

* * * * *